United States Patent [19]

Dykstra et al.

[11] Patent Number: 4,779,874

[45] Date of Patent: Oct. 25, 1988

[54] OIL EXPLORATION GAME

[76] Inventors: Sid Dykstra, 107 Woodvalley Ct. S.W., Calgary, Alberta T2W 5L2, Canada; John Weenk, 2312 Maunson Dr. N.E., Calgary, Alberta T2E6A2, Canada; Alan D. Archibald, 120 Hawkley Valley Rd. N.W., Calgary, Alberta, Canada, T3G 2E8

[21] Appl. No.: 43,719

[22] Filed: Apr. 29, 1987

[51] Int. Cl.[4] ..... A63F 3/00

[52] U.S. Cl. ..... 273/240; 273/278; 273/287

[58] Field of Search ..... 273/236, 240, 242, 243, 273/251, 252, 254, 256, 278, 287, 241

[56] References Cited

U.S. PATENT DOCUMENTS

| | | | |
|---|---|---|---|
| 2,157,589 | 5/1939 | Bullen et al. | 273/240 X |
| 2,299,803 | 10/1942 | Deaton | 273/278 |
| 3,061,313 | 10/1962 | Greene | 273/243 X |
| 4,394,019 | 7/1983 | Anthony et al. | 273/256 |

FOREIGN PATENT DOCUMENTS

| | | | |
|---|---|---|---|
| 2326216 | 4/1977 | France | 273/287 |

*Primary Examiner*—Leo P. Picard

*Assistant Examiner*—Benjamin Layno

*Attorney, Agent, or Firm*—William R. Hinds; George H. Dunsmuir

[57] ABSTRACT

A relatively simple, easy to play oil exploration game includes a rectangular parallelepipedic casing with a bottom drawer in one end thereof for carrying the game pieces. A horizontal bottom wall extends between the sides and ends of the casing defining a cover for the drawer. A plurality of partitions or panels are removably mounted in the open top of the casing. The top surface of the uppermost panel defines a playing surface. Each panel has a plurality of spaced apart, vertically aligned, circular openings defining oil wells. Irregularly shaped obstacles defining wet drilling locations or oil-containing wells are slidably mounted on the bottom wall and on the partitions beneath the uppermost panel. Simulated derricks of varying lengths are insertable into the top wall openings to simulate the drilling of wells and indicator pegs are subsequently insertable into drilled wells to indicate the presence or absence of oil. The game further includes play money, a marker for marking the playing surface with a readily erasable substance to delineate oil fields, and a score pad for keeping track of a players salary.

11 Claims, 2 Drawing Sheets

| WELL LEVEL | | | LAND | | OFFSHORE | |
|---|---|---|---|---|---|---|
| WET | DRY | | COST | SALARY | COST | SALARY |
| Green | Clear | 1 | 5,000 | 2,000 | 15,000 | 5,000 |
| Blue | Yellow | 2 | 15,000 | 5,000 | 30,000 | 10,000 |
| Red | Purple | 3 | 30,000 | 10,000 | 45,000 | 15,000 |
| FULL DEPTH | | | 75,000 | | 125,000 | |
| FIRST TO THIRD | | | 50,000 | | 85,000 | |

SALARY:

46

OIL EXPLORATION GAME

BACKGROUND OF THE INVENTION

This invention relates to a board game, and in particular to an oil exploration game.

There are several patents already in existence for games involving the exploration for and the recovery of oil. Examples of such patents are U.S. Pat. Nos. 2,299,803; which issued to C. U. Deaton Deaton on Oct. 27, 1942; 3,061,313, which issued to S. Greene on Oct. 30, 1962; 3,206,211, which issued to H. Koplin on Sept. 14, 1965; 3,729,198, which issued to Donald H. Shaffer on Apr. 24, 1973; 3,801,104, which issued to R. G. Potts et al on Apr. 2, 1974 and 3,844,567, which issued to R. L. Marker on Oct. 29, 1974.

It will be appreciated that with games of the type in question the instructions accompanying the gate must be as simple as possible while the game should be sufficiently interesting to hold the attention of the players. Moreover, it is preferable that the structure of the game be such that the game can readily be mass produced for sale to a large consumer market. In general, the patented devices are somewhat complicated, being directed towards mechanical or electromechanical drilling structures, or alternatively the mechanical structure of the games is simple, but the instructions for playing the game are unduly complicated.

The object of the present invention is to avoid the drawbacks of existing games of the oil exploration type by providing a structurally simple game, which lends itself to mass production and which is relatively easy to play.

BRIEF SUMMARY OF THE INVENTION

The present invention provides an oil exploration game comprising a hollow, parallelepipedic casing including a rectangular horizontal top wall defining a playing surface, a plurality of regularly spaced apart openings in the top wall, a plurality of rectangular horizontal partitions coextensive with the top wall and vertically spaced therefrom and from each other, the partitions being vertically spaced by different distances from the top wall such that the partitions simulate different depths, a plurality of spaced apart openings in at least all but the lowermost of the partitions vertically aligned with the openings in the top wall, a plurality of obstacles defining wet drilling locations slidable on each partition for random movement when the casing is shaken, first position indicators for indicating dry drilling locations, second position indicators for indicating wet drilling locations, a plurality of elongated simulated well derricks adapted to be inserted in the openings and each derrick having one of a plurality of different lengths, each length reflecting one of the different depths such that respective ones of the derricks can be inserted respectively through selected different numbers of the partitions to simulate drilling depth, at least one marker for delineating areas on the playing surface around at least one of the openings therein with a readily erasable substance whereby drilling areas can be defined and removed at the end of a game, simulated money for use by the players, and score pads for establishing a salary for each player.

BRIEF DESCRIPTION OF THE DRAWINGS

The invention will be described in greater detail with reference to the accompanying drawings which illustrate a preferred embodiment of the invention, and wherein.

DESCRIPTION OF THE PREFERRED EMBODIMENT(S)

Figure 1:
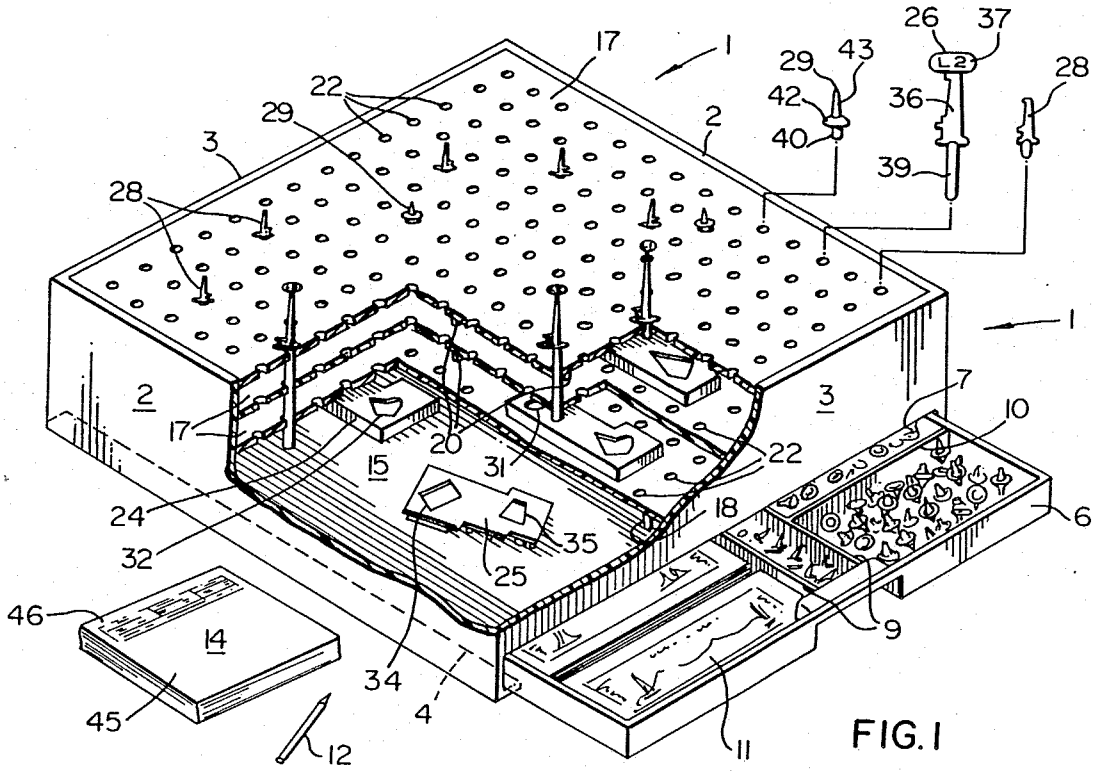
FIG. 1 is a schematic, partly sectioned, perspective view of an oil exploration game in accordance with the present invention.

With reference to FIG. 1, the game of the present invention is defined by a rectangular parallelepipedic casing generally indicated at 1. The casing 1 is defined by side walls 2 and end walls 3. Ledges 4 (one shown) extend inwardly from the bottom edges of the side walls for slidably supporting a drawer 6 in an opening 7 in one end wall 3. The drawer 6 includes longitudinally and transversely extending partitions 9 and 10, respectively, dividing the drawer into compartments for carrying various game pieces, play or simulated money 11, a pencil 12 and a pad 14. A fixed, horizontal partition 15 defines a cover for the drawer 6 and a bottom wall for the play area of the game. Three similar, rectangular panels or partitions 17 are removably mounted in the casing 1 above the partition 15. The panels are stacked one above the other and are held in spaced apart relationship by a plurality of rod-shaped legs 18 (one shown) at the corners and the centers of each side of each panel. Sagging of the panels 17 is prevented by longitudinally and transversely extending shallow ribs 20. A plurality of circular openings 22 are provided in each of the panels 17 for receiving various game pieces as described hereinafter in greater detail. The casing 1, the drawer 6 and the panels 17 lend themselves to modern plastic molding techniques. This is also true of most of the remaining elements of the game.

The game pieces used on or in the casing 1 include movable obstacles 24 and 25, simulated drilling rigs or derricks 26 of three different lengths, oil indicator pegs 28 and dry well indicator pegs 29. The obstacles 24 and 25 are designed to prevent or permit complete insertion of the derricks 26 into the wells defined by the openings 22. There are two different obstacles, namely an L-shaped obstacle 24 with a planar top wall, a circular opening 31 at one end and an irregular opening 32 at the other end thereof, and a generally rectangular obstacle 25 with stepped sides, one rectangular opening 34 and a frustotriangular opening 35.

Feet defined by planar side walls and short rods are provided on each obstacle 24 and 25 for slidably supporting the obstacles on the partition 15 and the bottom and middle panels 17.

The drilling rigs or derricks 26 include derrick-shaped bodies 36, a head 37 bearing the indicia L1, L2 or L3, and a rod-shaped base 39. The bases 39 are different lengths increasing from L1 to L3, which indicates the depth which can be reached using the derrick. The first derrick 26 with a head labelled L1 can be inserted through the top panel 17 into abutment with the next panel 17, the second, longer derrick 26 labelled L2 can be inserted through the top two panels into abutment with the third, inner panel 17, and the third, longest derrick 26 labelled L3 can be inserted through all panels 17 into abutment with the partitions 15.

Each of the pegs 28 and 29 is colourless or a different colour. There are three sets of pegs 28 which are shaped like small derricks and coloured green, blue and red for indicating the depth of a wet well, i.e. a well containing oil. There are three sets of pegs 29 which have rod-shaped bottom ends 40, semicircular central portions 42 and upwardly tapering top ends 43. The pegs 29 are clear, yellow and purple for indicating dry wells.

Figures 2, 3:
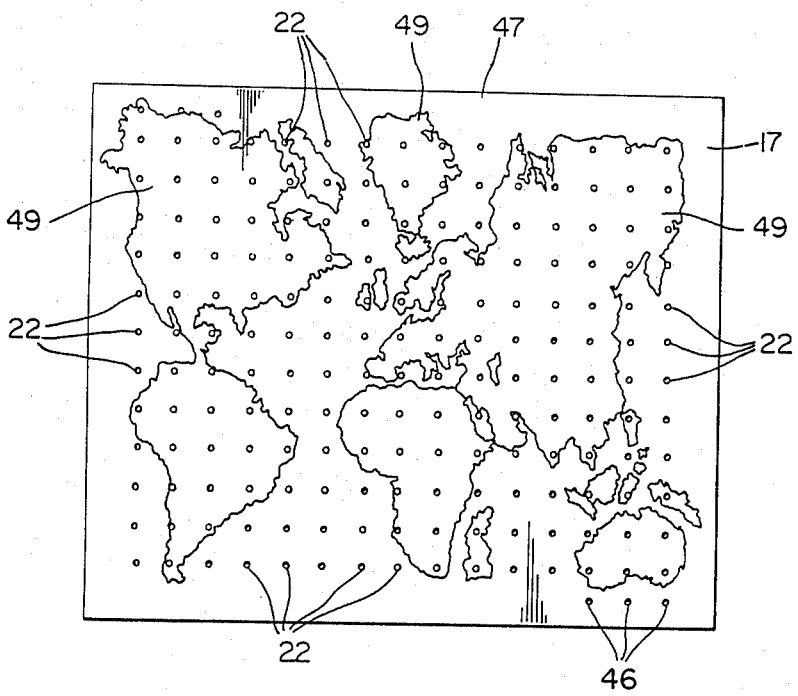
FIG. 2 is a plan view of the playing surface of the game Of FIG. 1.
FIG. 3 is a plan view of the top portion of a pad for recording the salaries of players.

As shown in FIG. 3, the pad 14 includes a plurality of sheets of paper, each sheet having a clear bottom area 45 (FIG. 1) and an indicia bearing top portion 46. The indicia indicate (1) the type of well, i.e. wet or dry, and the depth of each well and (2) the cost and salary for land and offshore wells.

Using the above described elements, the game is played in the following manner. The object of the game is to become the most successful oil company, i.e. the oil company with the highest projected net worth at the end of the game. The "projected net worth" is determined by multiplying the salary of the oil company (player or players) by ten, and adding cash on hand to the product. Oil companies may consist of one or more players.

In order to start the game, each oil company selects a name, which is used for the duration of the game. One oil company is chosen to be banker. Each oil company is given $100,000.00 cash, a score pad and a pencil for maintaining a record of increasing salary. The salary starts at $5,000.00. before starting a game, a time limit should be chosen. As player experience increases, the time limit can be decreased. First time players might choose the following time limits: one hour for two players, one and one-half hours for three players, and two to two and one-half hours for four players.

The oil company acting as the banker plays first, and play proceeds to the left from company to company for the remainder of the game. The three drilling rigs 26 are placed in the openings 46 in the bottom right hand corner of the top, playing surface 47 of the uppermost panel 17. Such playing surface includes lines defining land masses 49, roughly corresponding to the land masses of the world. The land masses 49 are a variety of colours other than blue, and the remainder of the surface 47 is coloured light blue to designate oceans or other bodies of water.

The player to the right of the banker lifts the casing 1 and, while maintaining it in the horizontal position, shakes the casing evenly to move the oil patches or obstacles 24 and 25. The casing is shaken only once at the beginning of each game. The banker uses a pencil 12 or a marker to draw boundaries around nine adjacent openings 22. The property thus defined is placed up for auction. Once a highest bid has been obtained, the successful oil company (player or players) writes or prints the company name within the boundaries and pays the purchase price to the banker. In the first round, each company must draw a property to be open for bidding. On each subsequent turn, each oil company collects a salary, and may do one of three things, namely (1) draw another piece of property and place it up for bidding, (2) drill for oil or (3) pass.

A property consists of from one to nine adjacent holes, except in the first round where the property must consist of nine holes. Each company can purchase up to three properties without being required to drill. Once three properties are owned, one hole in each property must be drilled before the company is permitted to bid on another piece of property. Each property purchased thereafter must be drilled before another property can be purchased.

Once a piece of property is placed open for bidding, the oil company to the left of the company drawing the property starts the bidding. The initial bid must be no less than $3,000.00 per hole up to five holes, and $15,000.00 for properties consisting of six to nine holes. There is no maximum bid. However, if a company bids an amount on a property exceeding the cash on hand and gets called on the bid, such company can forfeit all cash on hand to the bank. The property is then awarded to the last successful bidder having sufficient funds. During the bidding process, if a company chooses to pass on a bid, such company may not re-enter the bidding.

When an oil company elects to drill, the company selects a hole on a piece of property belonging to the company and pays drilling costs to the banker as indicated in the score pad. Drilling a hole directly to the second level (third panel 17) is not permitted without drilling to the first level. First to third level or full depth drilling is permitted at a higher cost as set out in the lines labelled "full depth" and "first to third" on the top portion 46 of the pad 14. It will be noted that the cost and salary for land masses 49 differs from off-shore or water wells. When drilling, if a hole is dry, the drilling rig 26 will bottom out. If oil is struck, i.e. if the top panel of one of the obstacles 24 or 25 is contacted, the drilling rig stands up prominently and cannot be forced any deeper. Once an opening 22 has been drilled, the rig 26 is removed and replaced with an appropriately coloured peg 28 or 29 (see the score pad—FIG. 3). When oil is struck, the salary of the player is adjusted accordingly. Each level can be drilled until oil is hit or to a third level dry. If a company accidently drills a hole on another's property, the drilling company must pay the cost of drilling and the owner of the property will receive all benefits.

At the start of its turn, each company receives a salary as set out on the score pad 14. No bank loads can be made, nor can an oil company loan money to another company, with one exception. If an oil company has had twelve dry drilling attempts, has a salary below $10,000.00 and less than $15,000.00 cash on hand, the company is considered to be destitute and eligible for a special bank loan of $100,000.00. When the company receiving the loan achieves a salary of $30,000.00 the company must repay $10,000.00 for each turn to a total of $150,000.00. The banker is to administer the load to ensure repayment. Only one loan is permitted for each oil company per game.

Once time has expired, all of the oil companies multiply their recorded salaries by ten, and add their cash on hand to the product. The company with the largest net worth wins the game.

Care must be taken to use pencils 12 or markers which can readily be removed from the top or playing surface 47 at the end of each game. Of course, replacement pads and markers will be available from the manufacturer and retailer of the game.

What is claimed is:

1. An oil exploration game comprising hollow, parallelpipedic casing means including rectangular, horizontal top wall means defining a playing surface, a plurality of regularly spaced apart openings in said top wall means; a plurality of rectangular, horizontal partition means coextensive with said top wall and vertically spaced therefrom and from each other; said partitions being vertically spaced at different distances from said top wall such that said partitions simulate different depths; a plurality of spaced apart openings in at least all but the lowermost of said partition means vertically aligned with the openings in said top wall means; a plurality of obstacle means defining wet drilling locations slidable on each said partition means for random movement when the casing means is shaken; first position indicator means for indicating dry drilling locations; second position indicator means for indicating wet drilling locations; a plurality of elongated simulated well derrick means adapted to be inserted in said openings, and each derrick means having one of a plurality of different lengths, each length reflecting one of said different depths such that respective ones of said derrick means can be inserted respectively through selected different numbers of said partition means to simulate drilling depth; marker means for delineating areas on said playing surface around at least one of the openings therein with a readily erasable substance, whereby drilling areas can be defined and removed at the end of a game; simulated money for use by the players; and score pad means for establishing a salary for each player.

2. A game according to claim 1, wherein said casing means includes side walls and end walls, the lowermost partition means extending between said side and end walls; drawer means slidable in one end of said casing means and normally covered by said lowermost partition means for carrying said first and second position indicator means, said well derrick means, said marker means, said simulated money and said pad means.

3. A game according to claim 2, wherein each said well derrick means includes an elongated body, a head bearing depth indicating indicia, and a rod-shaped base for insertion into one said opening in said top wall means.

4. A game according to claim 2, wherein said top wall means and all but the lowermost of said partition means are structurally and dimensionally similar, and removably mounted in said casing means.

5. A game according to claim 1, wherein each said obstacle means includes a top panel, a plurality of openings in said top panel, and feet for slidably supporting the obstacle means on said partition means.

6. A game according to claim 5, wherein each said well derrick means includes an elongated body, a head bearing depth indicating indicia, and a rod-shaped base for insertion into one said opening in said top wall means.

7. A game according to claim 5, wherein said top wall means and all but the lowermost of said partition means are structurally and dimensionally similar, and removably mounted in said casing means.

8. A game according to claim 1, wherein each said well derrick means includes an elongated body, a head bearing depth indicating indicia, and a rod-shaped base for insertion into one said opening in said top wall means.

9. A game according to claim 1, wherein said top wall means and all but the lowermost of said partition means are structurally and dimensionally similar, and removably mounted in said casing means.

10. A game according to claim 1 wherein said first and second position indicator means each include a number of visually distinguishable indicator means corresponding to the number of different lengths of said derrick means such that a given opening can be indicated by its simulated drilling depth after insertion and removal of one of said derrick means.

11. A game according to claim 1 including three of said partition means, and wherein said well derrick means are of three different insertable lengths so as to be extendable respectively through said top wall to a level adjacent but short of the uppermost of said partition means, to a level adjacent to but short of the next lowest of said partition means, and to a level adjacent the lowermost of said partition means.

* * * * *